United States Patent [19]

Meierhoefer

[11] Patent Number: 4,574,965

[45] Date of Patent: Mar. 11, 1986

[54] CONTAINER WITH INTEGRALLY FORMED PIERCING SITE

[75] Inventor: Eugene J. Meierhoefer, Hackettstown, N.J.

[73] Assignee: Health Care Concepts, Inc., Allamuchy, N.J.

[21] Appl. No.: 722,336

[22] Filed: Apr. 12, 1985

Related U.S. Application Data

[63] Continuation-in-part of Ser. No. 615,214, May 30, 1984, Pat. No. 4,513,871.

[51] Int. Cl.[4] ..... B65D 41/42

[52] U.S. Cl. ..... 215/32; 215/1 C; 215/247; 215/249

[58] Field of Search ..... 215/32, 1 C, 247, 249

[56] References Cited

U.S. PATENT DOCUMENTS

| | | | |
|---|---|---|---|
| 2,135,386 | 11/1938 | Crabbe | 215/247 |
| 2,231,418 | 2/1941 | Trotter | 215/247 |
| 3,387,609 | 6/1968 | Shields | 215/247 X |
| 3,392,859 | 7/1968 | Fischer | 215/247 |
| 3,547,297 | 12/1970 | Herbert et al. | 215/249 |
| 4,205,754 | 6/1980 | Nielsen et al. | 215/249 |
| 4,265,364 | 5/1981 | Baba | 215/249 |
| 4,390,104 | 6/1983 | Cummings | 215/249 X |
| 4,463,867 | 8/1984 | Nagel | 215/1 C X |

FOREIGN PATENT DOCUMENTS

| | | | |
|---|---|---|---|
| 1566102 | 5/1969 | France | 215/32 |
| 1175428 | 12/1969 | United Kingdom | 215/247 |

*Primary Examiner*—Steven M. Pollard
*Attorney, Agent, or Firm*—Leonard Belkin

[57] ABSTRACT

A container with a centrally located, integrally formed non-coring and non-leaking piercing site for use with sterile instruments. A double dome construction is employed to permit needle penetration without coring by the needle and provide sealing between the container and the needle. Provision is also made to insure sealing when a larger diameter plastic needle is employed. In another embodiment there is provided a container with a non-coring piercing site and a separate sealing cover.

11 Claims, 10 Drawing Figures

CONTAINER WITH INTEGRALLY FORMED PIERCING SITE

BACKGROUND OF THE INVENTION

This application is a continuation-in-part of my application Ser. No. 615,214 filed on May 30, 1984, now U.S. Pat. No. 4,513,871.

This invention relates to individually made molded plastic containers or bottles having non-coring piercing sites and a method utilizing said containers for the transfer of liquid.

The transfer of medicaments for patient treatment in a hospital or patient care setting between a container and a supply line, or between containers, is frequently accomplished by use of a needle and syringe, a transfer needle, or a needle (or spike) on the end of a solution transfer set.

For the withdrawal or addition of liquid or solution by needle and syringe or by transfer needle to or from a container, a typical container now in use is provided with a rubber stopper with a "thinned" or diaphragm-like section through which the metal needle is inserted. The function of the diaphragm configuration is to provide an entry site capable of being penetrated by the needle and to provide a seal around the needle shaft, and to permit penetration of the rubber without cutting out a small portion or core of rubber by the "heel" of the needle when the latter is thrust through the diaphragm section of the stopper. The supple and elastometric properties of the rubber make this penetration possible.

Lodging of the aforementioned portion or core of the rubber in the lumen of the needle, referred to as coring by the needle, presents the possibility of introducing this "particle" into the blood stream of the patient as well as interfering with the transfer of the solution and is to be avoided.

When a transfer set is employed to transfer solution from a container to a supply line, a larger diameter plastic needle is generally employed in a manner similar to the use of the metal needle as described above. In this situation, coring by the needle is to be avoided also, but sealing around the needle as it penetrates the stopper is more difficult to accomplish since it has been found that the hole formed by the larger diameter plastic needle tends to be irregular.

Containers currently in use are made of either glass or rigid plastic construction with the rubber stopper or a flexible bag in which there is a fabricated or built-up segment with a tubular appendage to accommodate or support the diaphragm-like membrane to be pierced by the metal or plastic needle.

Such containers are constructed of separate parts which must be assembled or fabricated. As the contents of the containers are usually sterile and it is necessary to maintain such sterility during the packaging process, it is apparent that there are significant costs involved in componentry and manufacture or processing to produce such a system of providing sterile medicaments to a hospital or patient bedside environment.

Recent developments in the technology of manufacturing plastic containers make it possible that a container can be formed, filled with sterile, non-pyrogenic solution, and sealed under sterile conditions in a single step. Even though machinery to accomplish such a manufacturing process is available, however, it has not been possible up to now to produce a container construction which can be formed in this way which will prevent coring of the needle as it penetrates the container and provide sealing around the shaft of the needle as it is thrust into the container.

Methods and apparatus for the molding and sealing of plastic containers are shown in U.S. Pat. Nos. 3,851,02 and 4,172,534. It is noted that the latter patent does deal with the problem of providing a needle puncture site, but the construction is an expensive one and does not take full advantage of the molding technology now available.

In my aforementioned patent application Ser. No. 615,214, there is described and claimed a container capable of being blow molded, filled with solution, and sealed with an integrally formed site which is non-coring and non-leaking when penetrated by a needle.

This is accomplished by utilizing a double dome comprising a main dome extending radially beyond the neck of the container and a secondary dome located off center on the upper surface of the main dome. The purpose of the main dome is to provide proper support for the secondary dome. The reason for the secondary dome being located off center has to do with the requirement to permit machine trimming of excess material from the mold seams without damaging the secondary dome.

Bottles or containers which can be made in accordance with the principles of the invention set forth in the earlier application range in size from vials having capacities of the order of 5 ml where only the steel needle will be employed up to containers or bottles having capacities of the order of 500 ml where the larger diameter plastic needle may also be used.

Production methods for blow molded containers can and do vary depending on the size of the container to be produced, its shape, and the degree of rigidity desired for the final product.

For example, a common practice in blow molding containers, especially those of small size, is to manufacture them in block form, that is, produce a row of containers joined by flash material or as multiple individual packages not in a block, but all from a single parison large enough to service multiple cavities per each mold-/parison cycle. Large containers are usually manufactured individually from a single parison.

When the vials are produced in block or multiple packages per single parison form, it is necessary to employ a trim die operation to remove the flash from the vials. A blade having the same silhouette is utilized to cut out the block of vials from the flash while the entire unit is held in the die block. Since the blade must clear the dome to avoid damaging the latter, it is necessary that the top of the secondary dome not be higher than that which is to be cut, or trimmed away. This is accomplished in the earlier application by off-setting the secondary dome from the center of the main dome, canting the piercable dome somewhat downward to make available the top of the main dome at an elevation at, or below the offset mold seam.

Under some circumstances it might be desirable, however, to be able to locate the secondary dome along the central axis of the main dome in order, in the case of the larger size containers, that is, containers of at least 25 ml in capacity, to permit, for example, better alignment of the larger diameter plastic needle with the neck of the bottle.

SUMMARY OF THE PRESENT INVENTION

In accordance with the principles of this invention, there is provided a container or bottle individually prepared from a single parison capable of being blow molded, filled with solution, and sealed with an integrally formed, centrally aligned site which is non-coring and non-leaking when penetrated by a needle.

It has been found that the action performed by the diaphragm section of a rubber stopper as described above can be simulated in an integrally formed section by forming a double dome in the container in lieu of, and in close proximity to where the stopper would ordinarily be located in a conventional container.

The double dome comprises a main dome extending radially beyond the neck of the container and a smaller or secondary dome located on the upper surface of the main dome. The mold seam on the main dome is directed away from the secondary dome so as to avoid intrusion into the structural formation of the latter.

The thickness of the plastic in the main dome is sufficient to support its shape and resist forces of deformation caused by penetration of the secondary dome during penetration. The thickness of the secondary dome is somewhat less than that of the main dome and is a function of the manufacturing process and its location, size, and depth.

In one preferred embodiment of this invention there is provided an individually manufactured blow molded plastic container of at least 25 ml. in capacity prepared from a single parison having a main body, a neck portion communicating with and extending from the main body, and a hollow dome of larger diameter than the neck formed on the opposite end of the latter. The dome is fully enclosed, is generally circular and concentric with the neck, and has a uniformly curved outer surface in which is located a secondary dome of smaller diameter substantially on the center line of the neck. The main dome mold seam is directed away from the secondary dome.

The container or bottle embodying the principles of this invention is sufficiently large in size as to be feasible to be individually manufactured from a single parison. When so constructed according to common practice, the flash is found only as tabs at the top and bottom ends of the container. To deflash the container, the bottom tabs are removed in the molding area following which the container or bottle is placed on a conveyor and passed through an enclosure containing a rapidly rotating propeller or paddle-like blade. When the blade strikes the tab, the latter is broken from the bottle without disturbing the secondary dome. In this case it is feasible to locate the piercing dome so that it is situated on the central axis or center line of the bottle.

When the container or bottle of sufficient capacity so as to be individually made from a single parison is completed in accordance with the principles of this invention, it is readily distinguishable from a container or bottle prepared in block or multiple vials per single parison form due to the type of residual seam which remains. In the container formed in block or multiple vial from a single parison form, the seam is in the form of an exposed or protruding knife edge clearly visible whereas in the container individually prepared from a single parison, the seam is smooth, non-protruding and barely visible.

Another embodiment of this invention is the method of transferring liquid utilizing said container.

In order to penetrate the container or bottle with a needle to effect the transfer of liquid, the pointed end of the needle is impressed on the secondary dome. A dimple is first formed in the wall of the secondary dome as the needle penetrates the secondary dome.

Dimpling of the surface of the secondary dome prevents coring by the needle, and, for a steel needle of small diameter, insures intimate contact between the plastic material and the shaft of the needle to insure proper sealing while the needle remains inserted in the container.

For use with a plastic needle, the interior surface of the neck is calibrated in diameter to match the diameter of the larger plastic needle so that sealing is maintained where the outer surface of the plastic needle is in contact with the inner surface of the neck.

The above described construction and method therefore are capable of accommodating both the metal and plastic needles, in both cases preventing coring by the needles and insuring proper sealing while a needle is being used to transfer liquid.

Still another embodiment of this invention comprises an integrally formed container with a non-coring piercing site in which sealing is provided by a self-sealing layer consisting of rubber or other suitable material. In this embodiment, multiple penetrations by the needle are possible while at the same time retaining the integrity of the container.

It is thus a principal object of this invention to provide a molded sealed container having a non-coring and non-leaking site of integral construction located along the central axis of said container.

Another object is a method of transferring liquid utilizing a container with an integrally formed piercing site.

Other objects and advantages of this invention will hereinafter become obvious from the following description of preferred embodiments of this invention.

DETAILED DESCRIPTION OF THE PREFERRED EMBODIMENT

Figure 1:
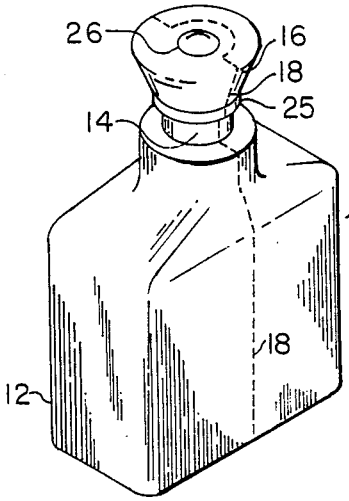
FIG. 1 is an isometric view of a container embodying the principles of this invention.

As illustrated in FIG. 1, container 10 consists of a hollow main body 12 which may be of any convenient cross section, such as square, rectangular, or circular, a neck portion 14, of uniform, circular inside diameter over a significant portion of its length, and a symmetrical main dome 16 of larger cross section. It is understood that by referring herein to a container, it is meant to include also a flexible bag with a fabricated or built-up segment with a tubular appendage capable of supporting the piercing site as hereinafter described.

As container 10 is blow molded from any suitable plastic material commercially available having the characteristics to be described later, there would be a mold seam 18 as is understood in the art whose location would depend on the equipment being employed to manufacture the container.

Container 10 is individually prepared from a single parison as distinguished from a group of containers prepared in block or multiple packages per single parison form from a parison and then separated from the flash.

By a parison is meant herein an extrusion of plastic in tubular form through a mandrel and die set, usually downwardly. The extrusion, as is understood in the art is cut off and transferred to a mold where either a block of, or multiple vials, are molded, or a single container is formed. For one container to be prepared from a single parison, the container size must be at least 25 ml. For containers of smaller capacity, the parison becomes too thin, looking like spaghetti, to be manageable, and so must be prepared in block or multiple packages per single parison form.

When container 10 is molded and ready for use, it is readily identifiable by visual examination whether it was constructed in block or multiple vials from a single parison form or whether it is a container individually made from a single parison. The container prepared in block or multiple packages per single parison form has a readily noticeable seam which appears as a knife edge. When prepared individually from a single parison, the seam is smooth and barely noticeable.

Figure 2:
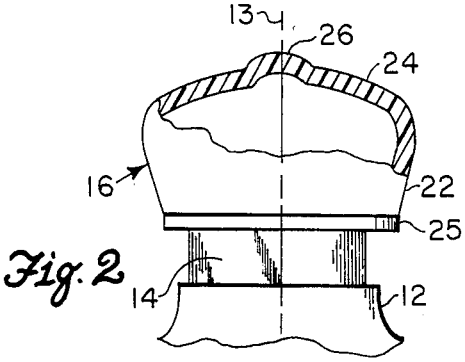
FIG. 2 is a side view of the upper portion of the domes partially cut away.
Figure 4C:
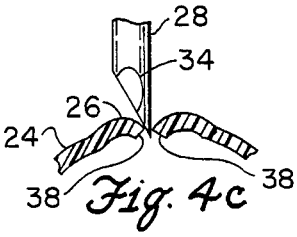
Figure 3:
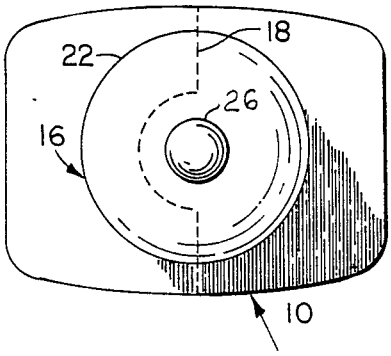
FIG. 3 is a plan view of the bottle shown in FIG. 1.
Figure 4D:
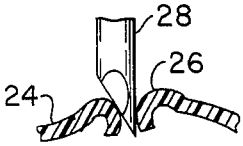

Referring more particularly to FIGS. 2 and 3, the integrally formed non-coring and non-leaking site comprising principal aspects of this invention includes main dome 16 having a generally circular outer rim 22 and an upper, outer surface or shell 24 which is generally uniformly curved and bulging outwardly and of uniform thickness. The purpose of main dome 16 is to properly support the piercing or secondary dome to be described below. A shoulder 25 provides additional support for dome 16.

Formed in outer surface 24 is a secondary dome 26 generally located on the center line 13 of neck 14 and having a diameter substantially less than the diameter of dome 16 and reduced in thickness. The central axis or center line of container or bottle 10 is the center line of neck 14 for the purpose of discussion herein. Seam 18, it will be noted, is non-protruding and barely visible, curving away from secondary dome 26 so as not to pass through the latter nor in any way interfere with, or influence, the shape or thickness of the secondary dome.

The plastic material comprising container 10 is sufficiently rigid in the neck and dome area to maintain its shape as shown in the course of ordinary use and handling but is sufficiently yielding or flexible, as it understood in the art, to function in the manner hereinafter described.

Referring to FIGS. 4*a*–4*d*, hollow steel needle 28 with its pointed tip 32 and opening or lumen 34 is shown penetrating secondary dome 26. It is understood that needle 28 may extend from a syringe (not shown) or may be simply a transfer needle device into which liquid from container 10 is to be transferred, or vice versa.

Figure 4A:
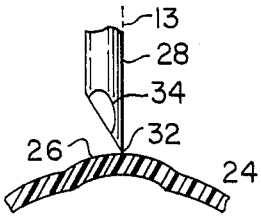
FIGS. 4*a*–4*d* illustrate penetration of the secondary dome by a steel needle.
Figure 4B:
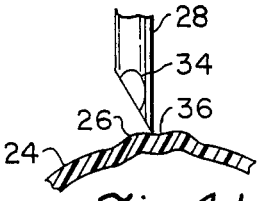

As seen in FIG. 4*a*, tip 32 of needle 28 is placed on said secondary dome 26 substantially lined up with the center line of neck 14, and as the needle 28 is thrust downwardly, a dimple 36 first forms in the wall of dome 26 and the needle 28 then penetrates the wall. By being able to line up needle 28 with the center line of neck 14 there is less risk that the needle will be caught on the side wall of neck 14. Dimpling prior to penetration is made possible by the preferred shape and reduced thickness of dome 26 as compared to main dome 16 and is necessary because it permits the exposed edge 38 of dome 26 to be directed away from lumen 34 so that coring will not occur, and in addition, as needle 28 is thrust into main body 12, the downwardly curved or directed exposed edge of the plastic wall is biased against the outer surface of needle 28 thereby providing a seal which prevents contaminants from entering container 10. Without the dimpling effect, proper sealing around the outer surface of the steel needle 28 will not be obtained.

Some bending downwardly of outer surface 24 of main dome 16 is permissible, but the thickness of dome 16, especially side wall 22, must be sufficient to prevent a collapse of the latter, which is described herein as a catastrophic deformation of main dome 16 and is to be avoided. The bulging of outer wall 24 outwardly is an important feature which permits some minor deformation but helps prevent collapse or catastrophic deformation of dome 16, with shoulder 25 contributing to this result.

It has been found that when a plastic transfer needle of larger diameter is employed with container 10 that coring is not likely to occur; however, proper sealing around the needle as it penetrates dome 16 does not occur, apparently due to a non-uniformity in the opening which is made by the needle. Penetration by such a large diameter needle is possible due also to the preferred shape and preferentially thinned section of secondary dome 26 as described.

Figure 5:
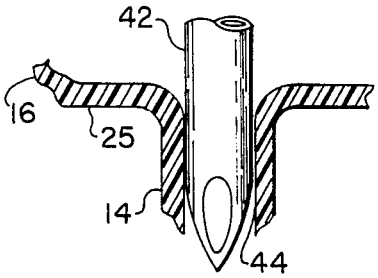
FIG. 5 illustrates the insertion of a plastic needle into the neck of the container shown in FIG. 1.

As seen in FIG. 5, in order to obtain proper sealing when a plastic needle 42 is employed, neck 14 formed as part of container 10 has an inside surface 44 circular in cross section with a diameter which is no greater than the outside diameter of needle 42, and is calibrated in its I.D. to cooperate with the plastic needle O.D. and is seamless and uniform for a significant length to insure sealing between needle 42 and surface 44. The location of secondary dome 26 on the center line of neck 14 makes it possible to align needle 42 properly to insure best results.

Container 10 thus may be employed with either steel needle 28 or the conventional oversized plastic needle 42. Under some conditions, container 10 may be used for the transfer of gaseous medicaments as well as liquids.

A container made according to the principles of this invention may be blow molded, filled with medicament or aqueous solution and sealed in one continuous operation using commercially available machinery. For example, containers according to the shape shown in the figures were molded from a tenite polyallomer (M 7853296E), made by Eastman Chemical Co., and a low density polyethylene (Rexene PE 107) made by El Paso Polyolefins Co. Both are commercially available. The machine employed was the "Bottle Pack" manufactured by Kocher Plastik, Sulzbach-Laufen, West Germany.

Figure 6:
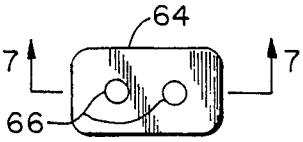
FIG. 6 is a plan view of a piercing site in another embodiment of this invention.
Figure 7:
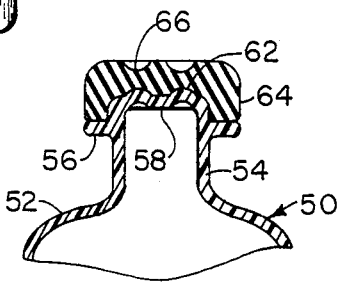
FIG. 7 is a view along 7—7 of FIG. 6 through a portion of the container.

Under some circumstances it is desirable to have a container in which the integrally made piercing site can be used repeatedly without adversely affecting the integrity of the container, for example, in the case of a large capacity bottle or bag, where withdrawals can be expected to be made over a period of time. A container of this type is illustrated in FIGS. 6 and 7.

Container 50, which can be either a rigid bottle or a bag with the built-up section, consists of an integrally formed main body 52, a neck 54 with a ledge 56, and a dome 58 with a pair of secondary dome piercing sites 62, which can be made in the same manner as described in connection with the container shown in FIGS. 1–5. In addition, this configuration can be obtained from the use of a mandrel with the container formed upside down. However, the manner of manufacture does not form a part of this invention. Dome 58 has a flat upper surface 63 of controlled thickness to support piercing sites 62. Piercing sites 62 have the same non-coring features as those previously described. However, in order to maintain sealing through the opening in each of the sealing sites during repeated use, which is anticipated for a larger container such as one of 500 ml capacity, dome 58 is fully enclosed by a cap 64 of conventional self-sealing material such as rubber supported on ledge 56 shaped to enclose piercing sites 62 as illustrated and provided on its upper surface with small indents 66 to show the location of the piercing sites 62 (that is, to indicate where the needle should be inserted). Dome 58 while shown in rectangular configuration can have any other suitable shape, such as round, oval, etc.

The methods and apparatus referred to herein for the production of the containers or bottles comprising this invention are conventional and well known art and form no part of this invention.

It is thus seen that there has been provided containers having integrally formed non-coring and non-leaking piercing sites for penetration by steel and plastic needles, and non-coring piercing sites capable of repeated use.

The containers designed according to the principles of this invention make it possible to produce high quality and reliable containers at a cost which is far less than the cost of containers which have been available up to now suitable for the applications herein described.

While only preferred embodiments of this invention have been disclosed, it is understood that various changes and modifications thereof are possible without departing from the principles of this invention as defined in the claims which follow.

What is claimed is:

1. A blow molded sealed container individually prepared from a single parison and of integral construction having a non-coring and self-sealing piercing site for penetration by a steel or plastic needle comprising:

a. a main body for containing or receiving a liquid;

b. a hollow neck portion extending from and communicating with the interior of said main body;

c. hollow, fully enclosed main dome means formed on the opposite end of said neck portion communicating with the interior of said neck having a generally uniformly curved outwardly bulging shell of uniform thickness generally concentric with said neck, the outer surface of said shell having formed therein a needle penetration site consisting of a secondary dome located on the center line of said neck and smaller than the diameter of said curved shell; and d. said container having a non-protruding mold seam passing through said main dome means, said seam on the outer surface of said dome means curving away from said secondary dome.

2. The container of claim 1 in which the wall of said main dome means is sufficiently thick to prevent catastrophic deformation of said main dome means as said steel or plastic needle dimples and penetrates said secondary dome, the wall thickness of the latter being significantly less than the wall thickness of said main dome means to insure non-coring penetration by said steel or plastic needle of said secondary dome and maintenance of sealing around the outer surface of said steel needle.

3. The container of claim 1 in which said neck has a circular inside opening of uniform diameter matching the diameter of said plastic needle for a significant distance to prevent leaking.

4. The container of claim 1 having a capacity of at least 25 ml.

5. The method of adding or withdrawing liquid from an integrally formed container having a main body, a hollow neck portion extending from and communicating with the interior of said main body, and hollow, fully enclosed main dome means formed on the opposite end of said neck portion communicating with the interior of said neck generally symmetrical with said neck, the outer surface of said shell having a secondary dome, said method comprising the steps of placing the pointed tip of a hollow needle having a lumen on said secondary dome pointed in the direction of said neck, thrusting said needle down to form initially a dimple in the wall of said secondary dome, then penetrating said secondary dome by said needle, and thrusting said needle through said neck into the main body of said container to effect the transfer of said liquid, the downwardly directed exposed edge of the wall of said secondary dome being biased against the outer surface of said needle thereby providing a seal which prevents contaminants from entering said container.

6. The method of claim 5 in which said secondary dome is located on the center line of said neck and said needle enters said secondary dome substantially along said center line.

7. The method of claim 6 in which the wall thickness of said secondary dome is less than the wall thickness of said main dome.

8. A blow molded sealed container of integral construction having a non-coring piercing site for penetration by a needle comprising:

a. a main body for containing a liquid;

b. a hollow neck portion extending from and communicating with the interior of said main body; and c. hollow, fully enclosed main dome means formed on the opposite end of said neck portion communicating with the interior of said neck having a flat upper surface of controlled thickness in which is an integrally formed needle piercing site consisting of a secondary dome located on said upper surface; and d. means enclosing said needle piercing site for providing sealing around said needle as the latter penetrates said piercing site and after said needle is withdrawn to permit repeated penetration of a needle while maintaining sealing integrity of said container.

9. The container of claim 8 in which said sealing means comprises a covering of self-sealing material for the piercing site.

10. The container of claim 8 in which said sealing means includes means to indicate where said needle should penetrate said main dome to pass through said piercing site.

11. The container of claim 10 in which said flat upper surface of said main dome means is provided with multiple piercing sites.

* * * * *